US006854216B2

(12) United States Patent
Ahrens et al.

(10) Patent No.: US 6,854,216 B2
(45) Date of Patent: Feb. 15, 2005

(54) SELF-STORING HANDRAIL ASSEMBLY FOR TELESCOPING SEAT ASSEMBLY

(75) Inventors: Kenneth A. Ahrens, Mattawan, MI (US); Richard A. Vance, Carmel, IN (US); David McCoy, Battle Creek, MI (US); Daniel R. Victor, Kalamazoo, MI (US)

(73) Assignee: Interkal, LLC, Kalamazoo, MI (US)

( * ) Notice: Subject to any disclaimer, the term of this patent is extended or adjusted under 35 U.S.C. 154(b) by 0 days.

(21) Appl. No.: 10/391,720

(22) Filed: Mar. 18, 2003

(65) Prior Publication Data

US 2004/0182012 A1 Sep. 23, 2004

(51) Int. Cl.[7] ..... E04H 3/12
(52) U.S. Cl. ..... 52/9; 52/8; 52/183
(58) Field of Search ..... 52/9, 183, 8; 256/59, 256/67, 19; D25/41

(56) References Cited

U.S. PATENT DOCUMENTS 4,006,564 A * 2/1977 Wiese ..... 52/9
4,011,695 A 3/1977 Simmons, Sr.
4,014,522 A * 3/1977 Sutter ..... 256/59
4,260,277 A * 4/1981 Daniels ..... 403/235
4,361,991 A * 12/1982 Wiese ..... 52/9
4,976,455 A * 12/1990 Brammer, Sr. et al. ..... 280/762
D399,009 S * 9/1998 Victor et al. ..... D25/38
5,813,663 A * 9/1998 Victor et al. ..... 256/59
6,076,306 A 6/2000 Victor et al.
6,185,875 B1 * 2/2001 Victor et al. ..... 52/9
6,328,285 B1 * 12/2001 Wiseman ..... 256/59

* cited by examiner

*Primary Examiner*—Brian E. Glessner
*Assistant Examiner*—Basil Katcheves
(74) *Attorney, Agent, or Firm*—Miller, Canfield, Paddock and Stone P.L.C.; Robert K. Roth, Esq.

(57) ABSTRACT

A self-storing telescoping seat assembly is disclosed which comprises rows of seating movable between a retracted position where the rows of seating are generally stacked on top of one another, to an extended position and a handrail assembly affixed to a corresponding row of seating in a single assembled position with respect to that row. The handrail assembly stays in the single assembled position as the rows move between the extended position and the retracted position. The handrail assembly can have a top handrail and a lower handrail which cooperate to form an opening, and the opening is preferably adapted to receive the front face of a deck of a row of seating when the rows of seating are in the retracted position. A front face can be formed by the rows of seating in the retracted position, and the handrail assembly has a post which preferably extends in front of the front face when the rows of seating are in the retracted position. The handrail assembly can also have the top handrail and bottom handrail extend in front of the front face of the corresponding deck.

16 Claims, 9 Drawing Sheets

SELF-STORING HANDRAIL ASSEMBLY FOR TELESCOPING SEAT ASSEMBLY

FIELD OF THE INVENTION

This invention relates to improvements to telescoping seat assemblies, and, more particularly, to a telescoping seat assembly with a self-storing handrail assembly.

BACKGROUND OF THE INVENTION

Telescoping seat assemblies are commonly used in school gymnasiums, sporting arenas and other areas where it is desirable to be able to move the entire seating assembly between an extended position where rows of seating (typically comprising either bleacher seats, stadium seats, etc.) are deployed, and a retracted position where the rows of seating are telescoped into a reduced area for storage. Recently it has become desirable to have handrail assemblies positioned on the telescoping seat assemblies, often positioned in a center aisle free of seats. U.S. Pat. No. 6,185,875 to Victor et al shows an elegant and efficient design of a handrail assembly incorporating both a top handrail and a lower handrail, forming a "P-rail". The top and bottom handrails face away from the front and toward the rear, attached to and extending over a row of seating. The P-rail allows users of varying heights to have something to hold onto as they make their way along the rows of seating.

However, such known handrail assemblies need to be moved from their assembled position before the telescoping seat assembly can be moved to the retracted position. This can be accomplished by removal of floor bolts or other fasteners to allow for detachment of the handrail assembly from the rest of the telescoping seat assembly. Alternatively, removal of fasteners can allow the handrail assembly to be pivoted to a stowed position so that the telescoping seat assembly can then be moved to the retracted position without interference. After returning the telescoping seat assembly from the retracted position to the extended position, the handrail assembly would need to be reinstalled. It would be desirable to have a handrail assembly that can be used with a telescoping seat assembly without requiring partial or complete disassembly and reassembly, with its attendant labor costs.

SUMMARY OF THE INVENTION

In accordance with a first aspect, a self-storing telescoping seat assembly comprises rows of seating, movable between a retracted position where the rows of seating are generally stacked on top of one another, to an extended position and a handrail assembly affixed to a corresponding row of seating in a single assembled position with respect to that row, wherein the handrail assembly stays in the single assembled position as the rows move between the extended position and the retracted position. In accordance with another aspect, the handrail assembly has a top hand rail and a lower handrail which cooperate to form an opening, and the opening is adapted to receive the front face of a deck of a row of seating when the rows of seating are in the retracted position. In accordance with another aspect, a front face is formed by the rows of seating when in the retracted position, and the handrail assembly has a post which extends in front of the front face of the row immediately above the corresponding row of seating when the rows of seating are in the retracted position. In accordance with another aspect, the post of the handrail assembly is affixed to one of the front faces and the top handrail extends from the post in front of the front face of the corresponding deck, and the handrail assembly does not interfere with movement of the rows of seating between the extended position and the retracted position.

From the foregoing disclosure and the following more detailed description of various preferred embodiments it will be apparent to those skilled in the art that the present invention provides a significant advance in the technology and art of telescoping seat assemblies. Particularly significant in this regard is the potential the invention affords for providing a high quality, low cost, handrail assembly which eliminates the need for labor intensive removal of the handrail assembly to permit movement of the telescoping seat assembly to and from the retracted position. Additional features and advantages of various preferred embodiments will be better understood in view of the detailed description provided below.

Figure 1:
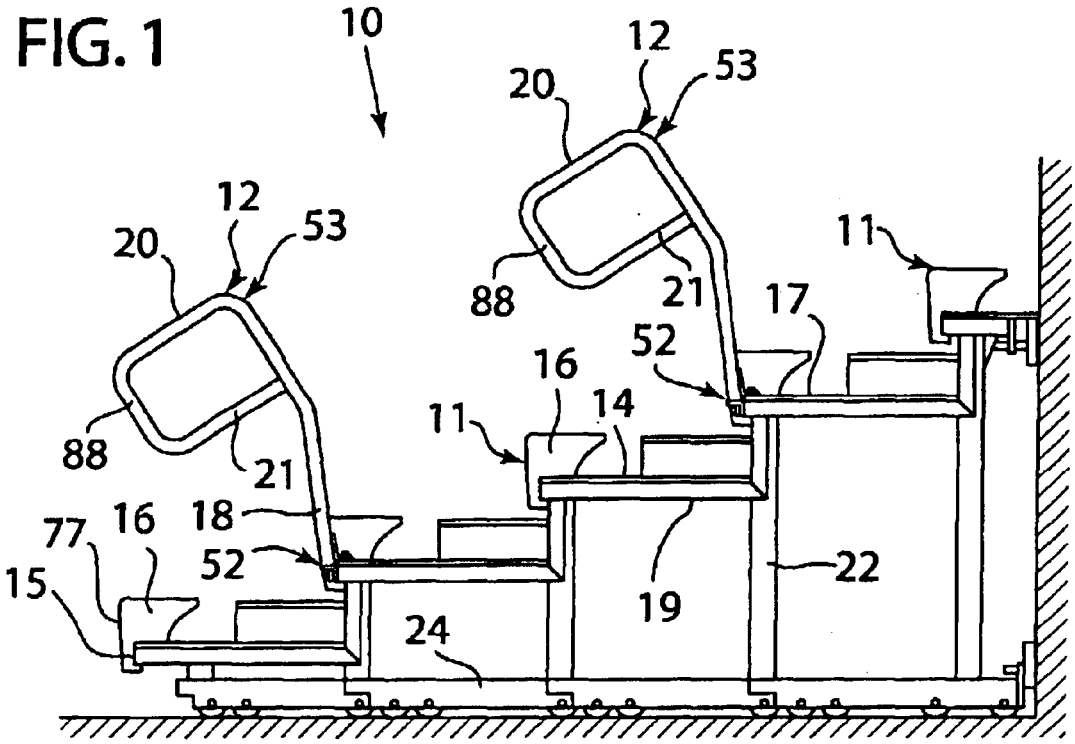
FIG. 1 is a side view of a telescoping seat assembly with a self-storing handrail in accordance with a preferred embodiment.

It should be understood that the appended drawings are not necessarily to scale, presenting a somewhat simplified representation of various preferred features illustrative of the basic principles of the invention. The specific design features of the self-storing telescoping seat assembly as disclosed here, including, for example, the specific dimensions of the handrail, will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation illustrated in the drawings. "Above" refers to the orientation of FIGS. 1 and 2. "Front" or "frontward" refers to the left direction in the plane of the paper FIGS. 1 and 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the self-storing telescoping seat assembly disclosed here. The following detailed discussion of various alternative and preferred features and embodiments will illustrate the general principles of the invention with reference to a telescoping seat assembly suitable for use with bleacher seats. Other embodiments suitable for other applications will be apparent to those skilled in the art given the benefit of this disclosure.

Referring now to the drawings, in FIG. 1 a telescoping seat assembly 10 in accordance with a preferred embodiment is shown in an extended position and is seen to comprise rows of seating 11 comprising a series of decks 14 and seats, such as, for example, bleacher seats 16. The decks have top faces 17 which people may walk on, a bottom face 19 hidden from view, and a front face 15. A horizontal framework 24 cooperates with a vertical framework 22 so that the entire seat assembly may telescope between the extended position shown in FIG. 1 and a retracted position shown in FIG. 2. Movement of the telescoping seat assembly may be accomplished either manually or by an electric motor.

Figure 2:
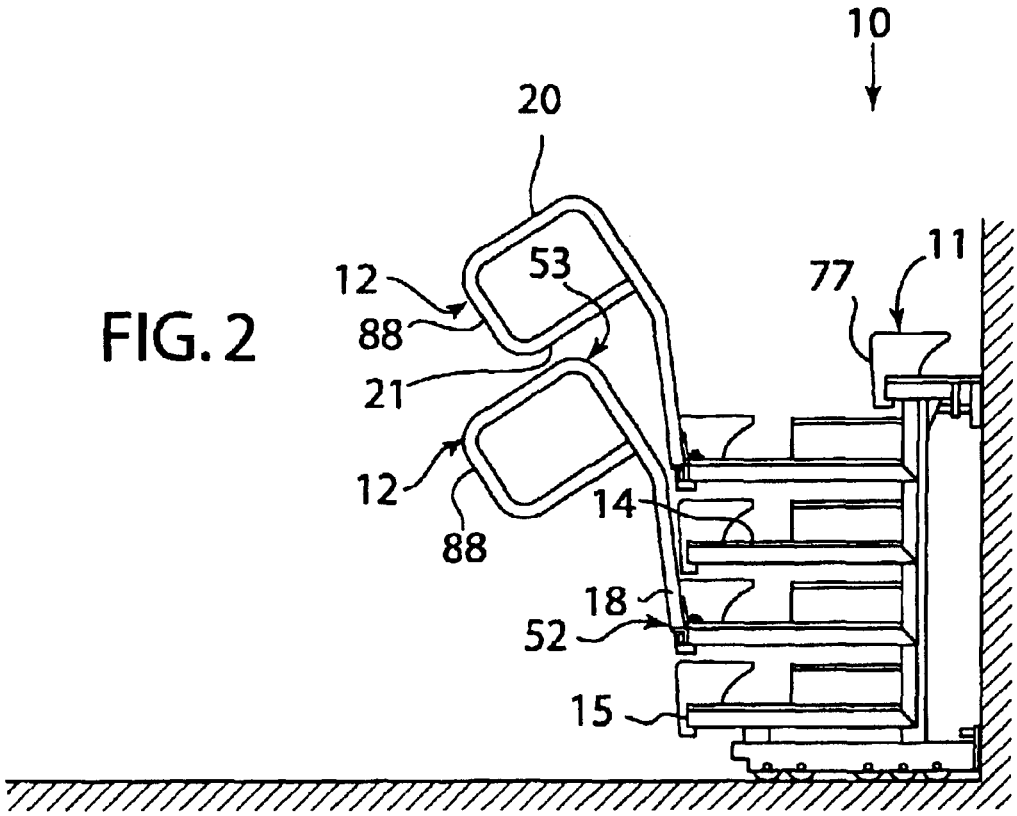
FIG. 2 is a side view of the telescoping seat assembly of FIG. 1 shown in a retracted position.

A handrail assembly 12 comprises a series of posts 18 having a first end 52 and a second end 53, preferably rigidly attached to the front face 15 and top face 17 of at least one deck 14 near the first end 52. In accordance with a highly advantageous feature, the telescoping seat assembly is self-storing. Self-storing, as that term is used herein, means that the handrail assembly 12 does not need to be moved or removed once it is installed in its single assembled position shown in the drawings. As seen in FIG. 2, no additional operations to the handrail assembly are required to permit the telescoping seat assembly 10 to move between the extended and retracted positions. The positioning of the handrail assembly 12 cleverly accommodates such movement. Top handrail 20 and bottom handrail 21 are connected by a front leg 88, and can be formed as a unitary extension of the post 18. The handrail assembly does not interfere with the movement of the rows of seating between extended and retracted positions because, as seen in FIGS. 1 & 2, the handrails 20, 21 extend away from and in front of the front face 15 of the deck 14 to which they are attached.

As seen in FIG. 2, when the rows of seating are in the retracted position, the front faces 15 of the telescoping seat assembly are seen to be generally vertically aligned with one another. The posts 18 of the handrail assembly extend in front of the front faces 15 of the telescoping seat assembly when in both the extended position and the retracted position. Thus, the position of the posts cooperates with the position of the handrails to eliminate the need for removal or repositioning prior to telescoping to the retracted position.

Preferably the handrail assembly is positioned every two rows of seating. It will be readily apparent to those skilled in the art, given the benefit of this disclosure, that other intervals will be possible, as for example by modifying the length of the post, the height of the top and lower handrails, etc.

Figure 3:
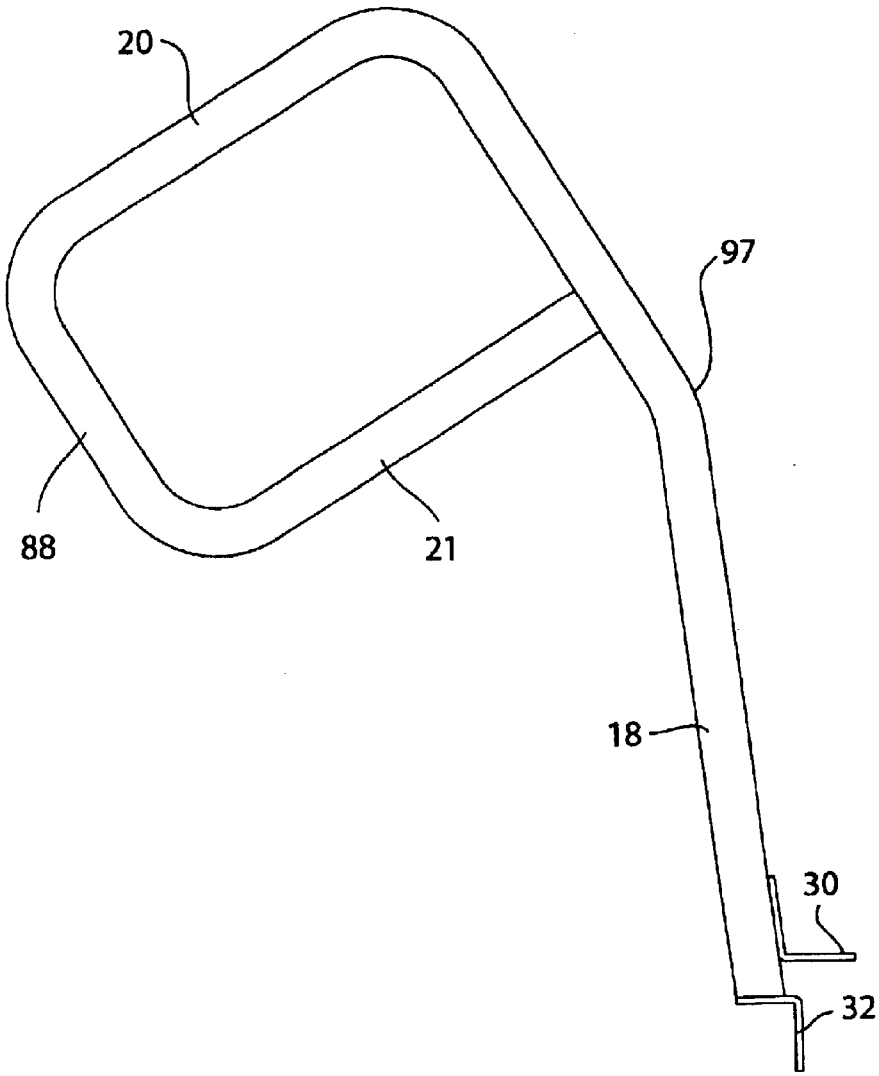
FIG. 3 is a side view of the handrail of FIG. 1.
Figure 4:
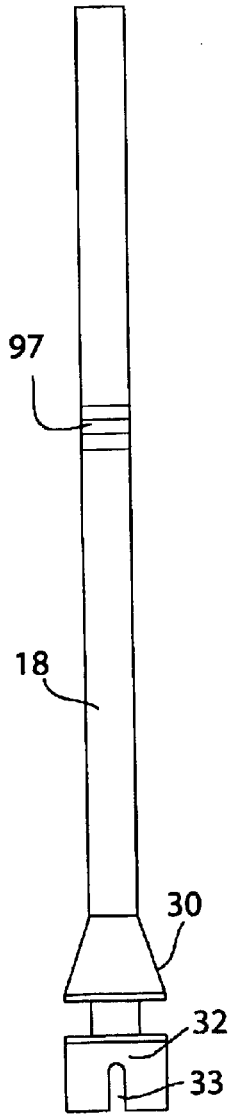
FIG. 4 is a rear view of the handrail of FIG. 1.

As seen in FIGS. 2, 3 and 4, a pair of attachment brackets 30, 32 can connect each post 18 to the deck row of seating. Each bracket may be L-shaped and/or have a bend 97, for example, and may be connected to the post by welding, bolts, etc. Bracket 30 may be connected to the top face 17 of the deck of a corresponding row of seating, and bracket 32 may be connected to the front face 15 of the deck of a corresponding row of seating. Alternatively, the bracket may be attached to just the front face or just the top face 17. Other attachment relationships will be readily apparent to those skilled in the art given the benefit of this disclosure. Bracket 32 may optionally be provided with an alignment slot 33 to account for variances in part size and other tolerance related discrepancies and variations in manufactured components, enhancing ease of assembly. The post may preferably be provided with an optional bend 99 so that the handrails 20, 21 are shifted further frontward. This can be advantageous in preventing the post from interfering with another post above or below.

Figure 5:
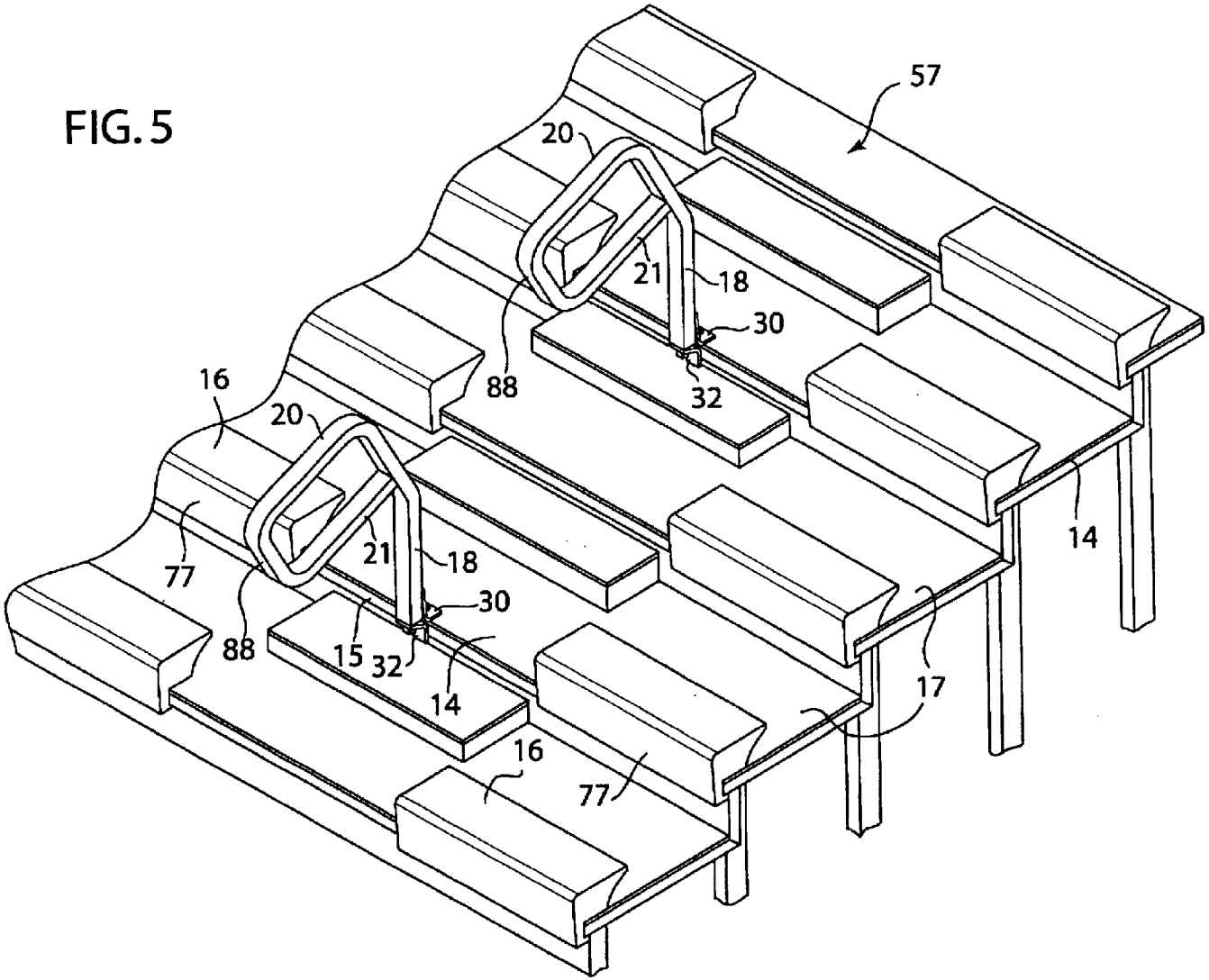
FIG. 5 is a perspective view in an extended position of a self-storing telescoping seat assembly in accordance with the preferred embodiment of FIG. 1.
Figure 6:
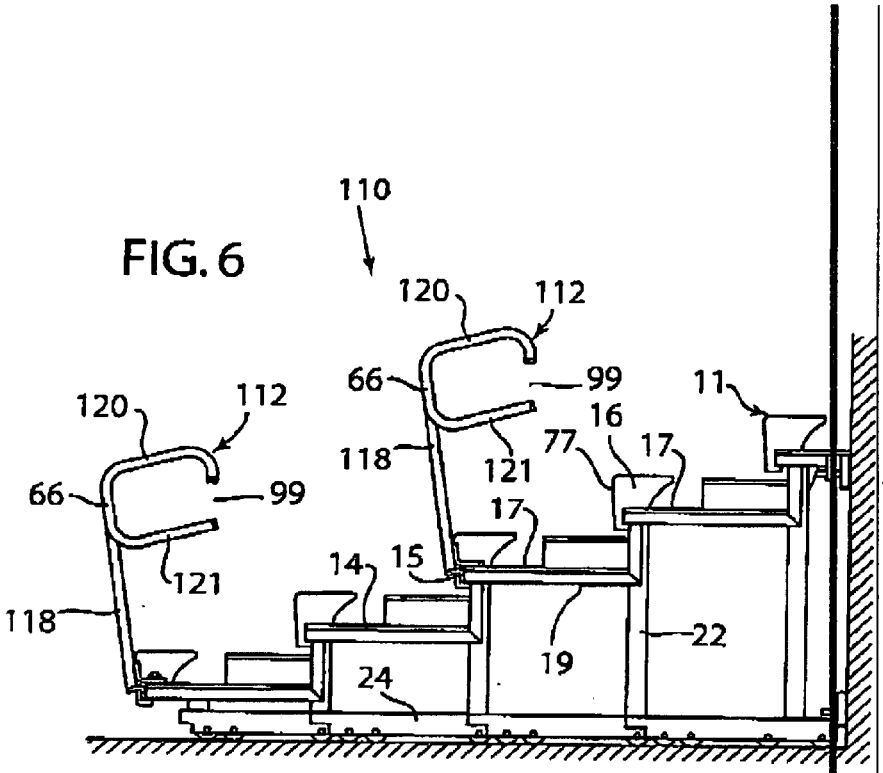
FIG. 6 is a side view of a telescoping seat assembly with self-storing handrail in accordance with a second preferred embodiment, shown in an extended position.

FIG. 5 is a perspective view of the telescoping seat assembly shown in the extended position with the front faces 77 of bleacher seats 16 staggered in a normal seating arrangement. Bleacher seats 16 are separated by a center aisle 57, with the handrail assembly positioned in the center aisle. The posts 18 are attached to at least the front face 15 of a corresponding deck, and the top and bottom handrails 20, 21 respectively, are seen to extend frontward and away from the deck to which they are attached via post 18.

Figure 7:
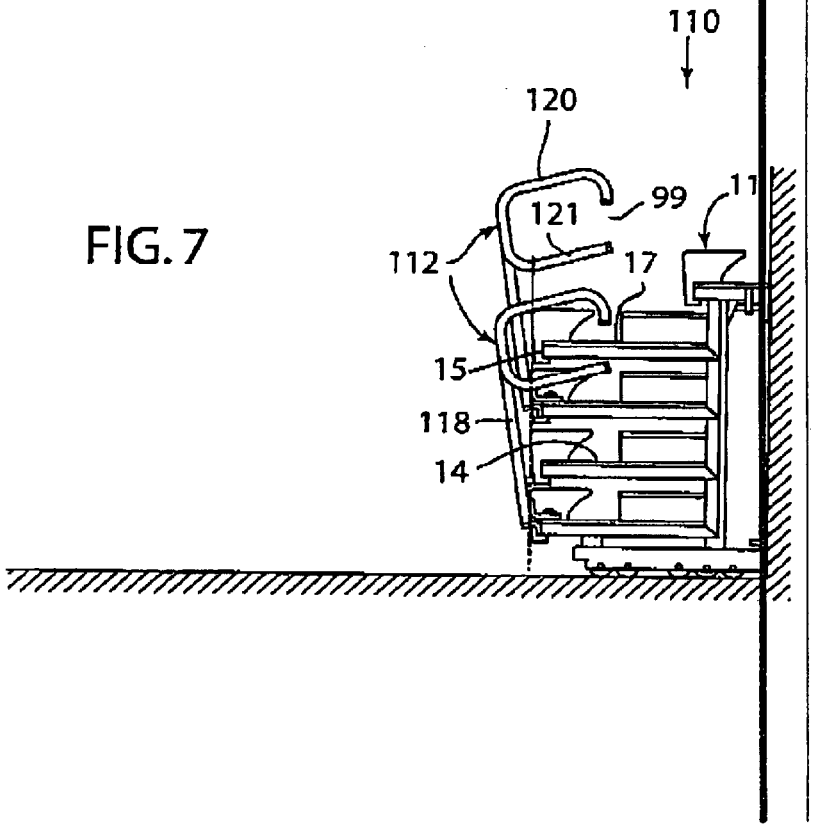
FIG. 7 is a side view of the telescoping seat assembly of FIG. 6 shown in a retracted position.
Figure 8:
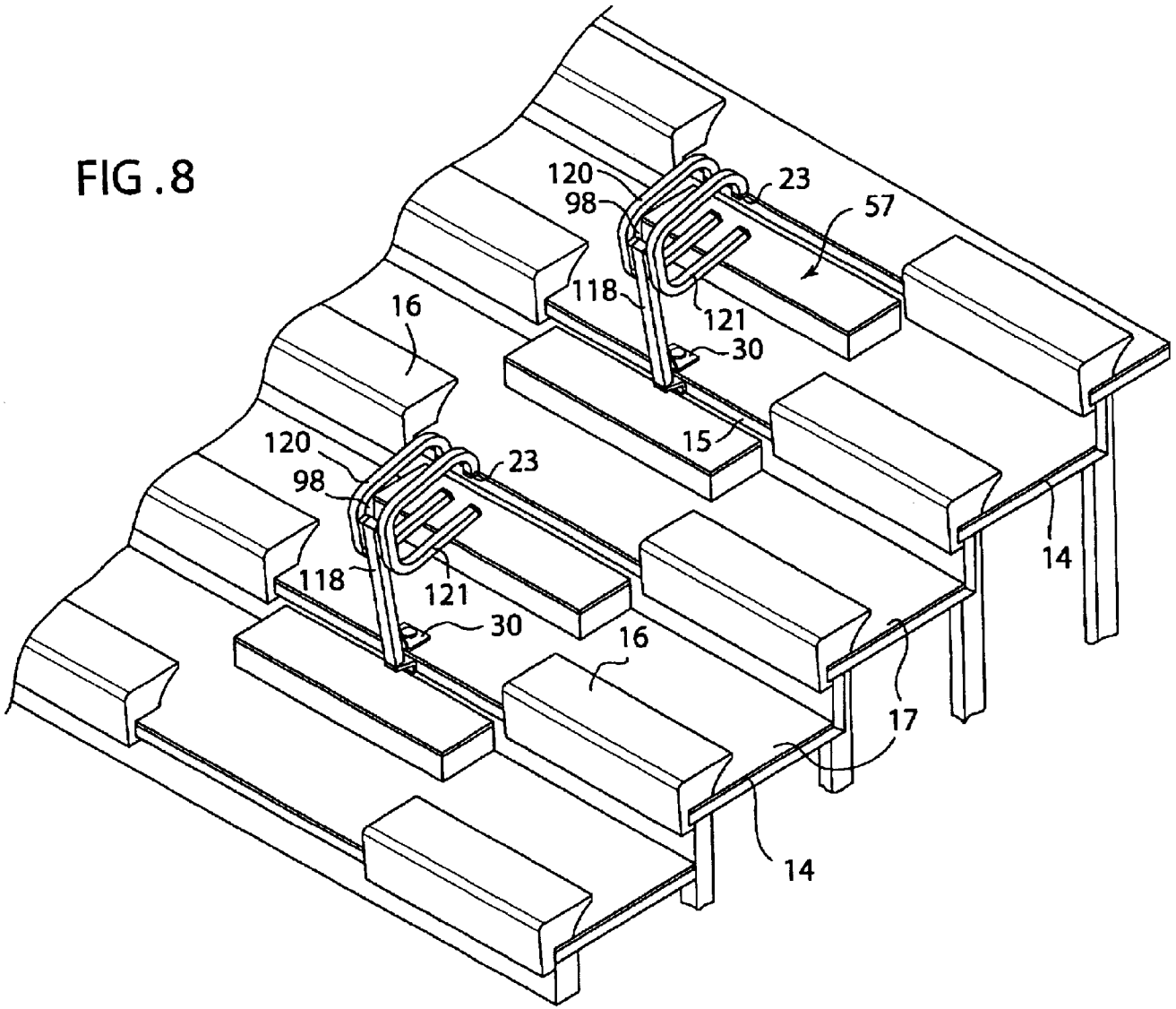
FIG. 8 is a perspective view in an extended position of a self-storing telescoping seat assembly in accordance with the preferred embodiment of FIG. 6, showing a handrail assembly with left and right handrails.
Figure 9:
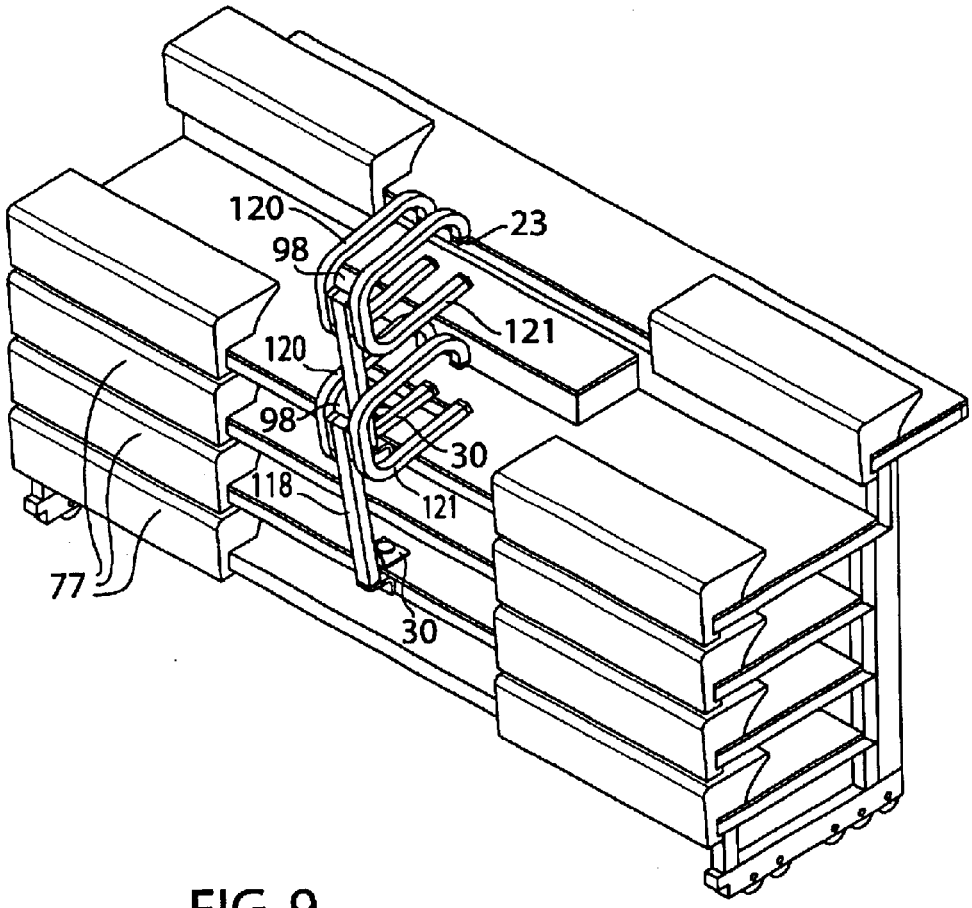
FIG. 9 is a perspective view in of the telescoping seat assembly of FIG. 6 shown in a retracted position.
Figure 10:
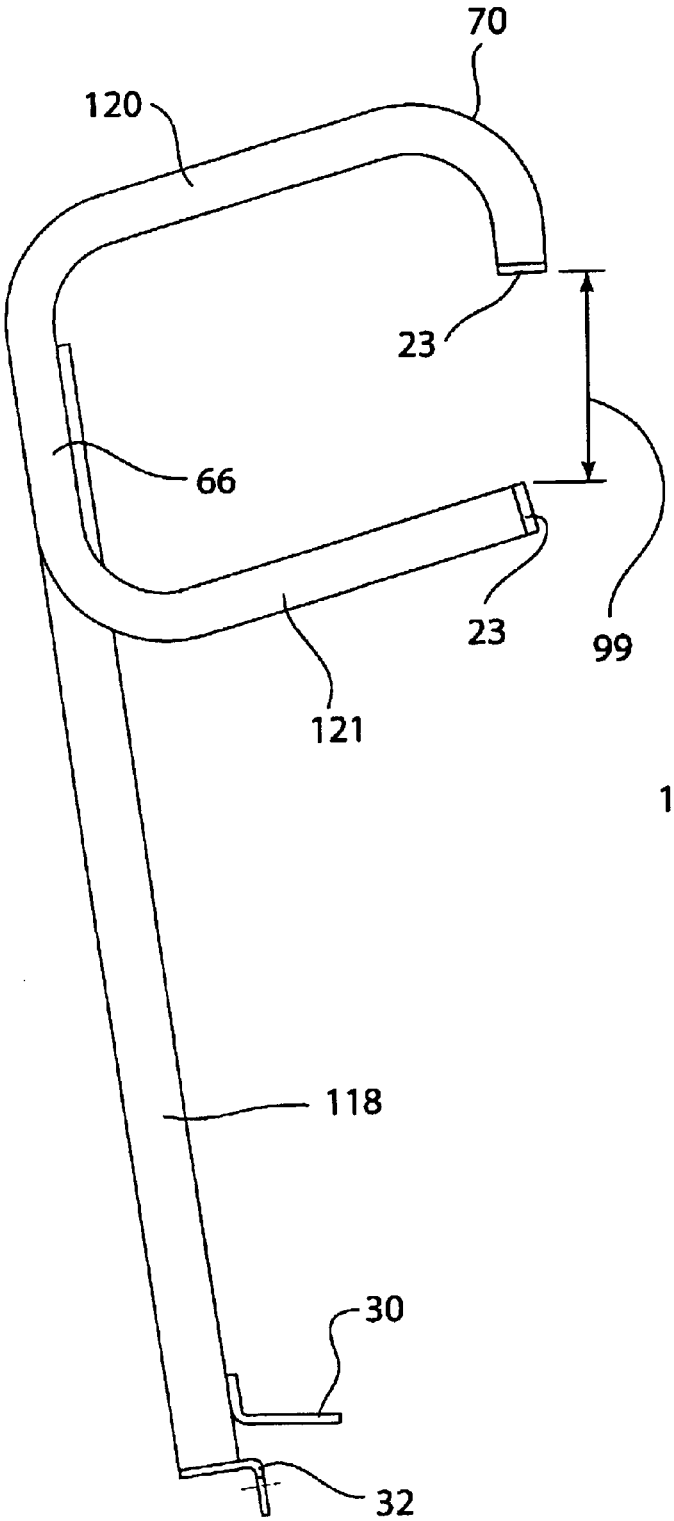
FIG. 10 is a side view of the handrail of FIG. 6.

FIGS. 6–11 show a second preferred embodiment of a telescoping seat assembly 110. Instead of having the rails face frontward, a pair of top handrails 120 and bottom handrails 121 face rearward. Top handrail 120 and lower handrail 121 are seen to have an opening 99. The length of the post 118 and size of the handrail assembly is such that when the telescoping seat assembly moves to the retracted position as shown in FIG. 7, the top rail 120 attached to one row of seating avoids the bottom rail 121 attached to another row of seating above. Further, the opening 99 is sized to receive a row of seating so that the top rail 120 is above the top face 17 of the deck 14 and the lower rail 121 is below the bottom face 19, all without the row of seating contacting the handrail assembly 112. Preferably each top handrail 120 and a corresponding lower handrail 121 are formed as a unitary construction, connected by center portion 66. Upper handrail 120 may end at opening 99 in a termination bend 70 and an endcap 23 (FIGS. 8–10). Lower handrail 121 may be straight as shown in the Figs., or curved, and also terminate with an endcap 23.

Figure 11:
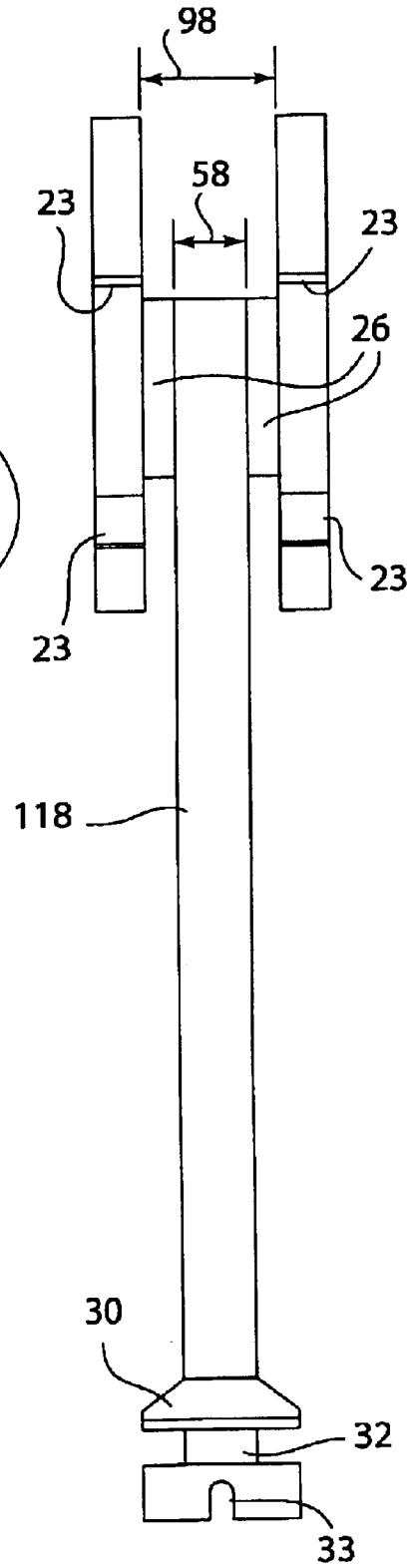
FIG. 11 is a rear view of the handrail of FIG. 6.

Left and right handrails of the handrail assembly 112 are separated by a separation width 98, seen best in FIGS. 8, 9 and 11. Advantageously, the separation width 98 exceeds a width 58 of each post 118. This allows the separation width 98 to receive a post 118 mounted on a row of seating above when the telescoping seat assembly is in the retracted position. To space the left and right handrails apart, thereby ensuring that the separation distance 98 exceeds the width 58 of the post 118, spacer elements 26 may be used. Alternatively, the spacer elements and handrails may be formed of a unitary or one-piece construction. As with the previous embodiment, the handrail assembly 112 may preferably be positioned every two rows of seating, as seen best in FIG. 8.

Figure 12:
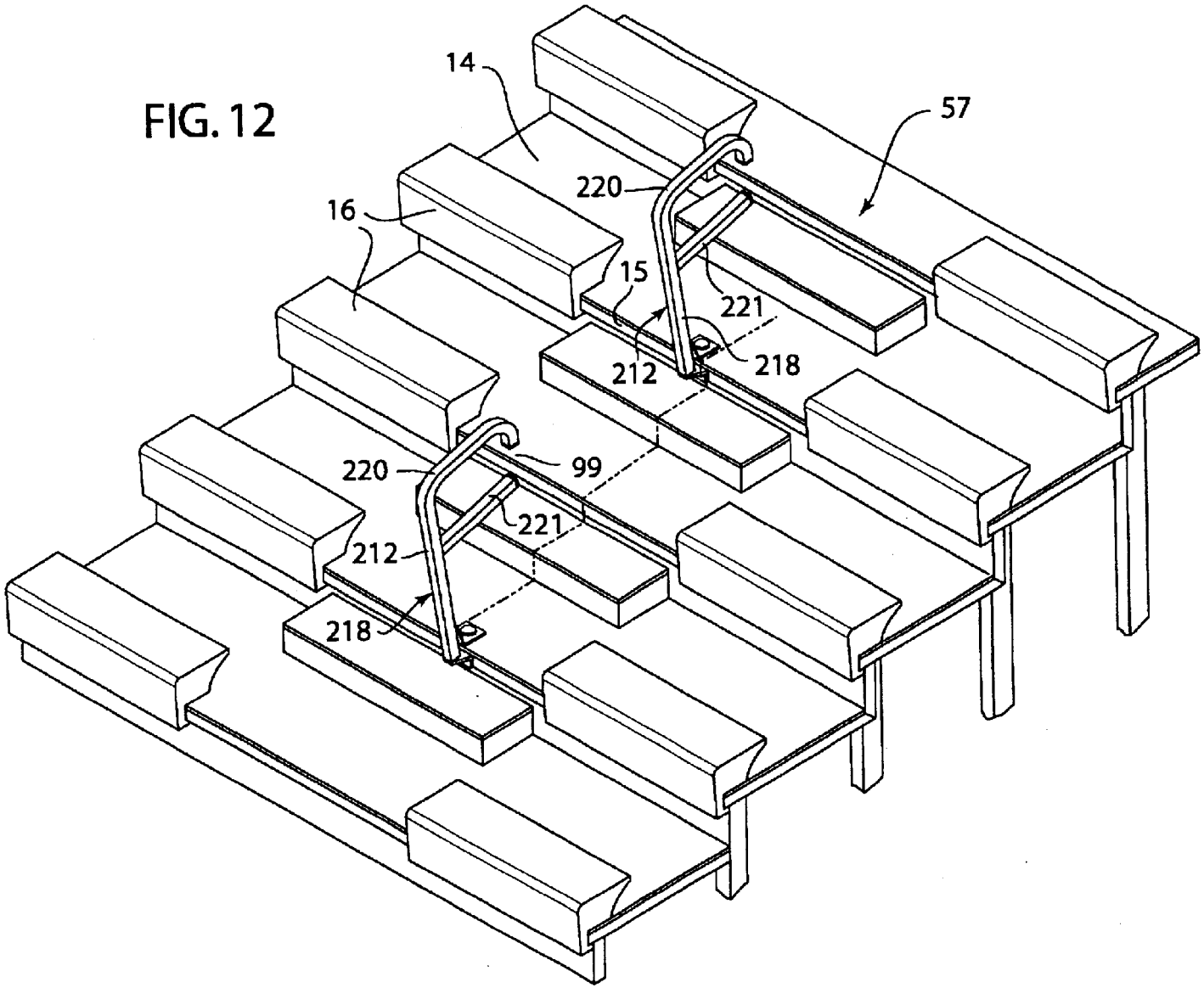
FIG. 12 is a perspective view of a handrail assembly in accordance with another alternate preferred embodiment with offset handrails, shown in the extended position.
Figure 13:
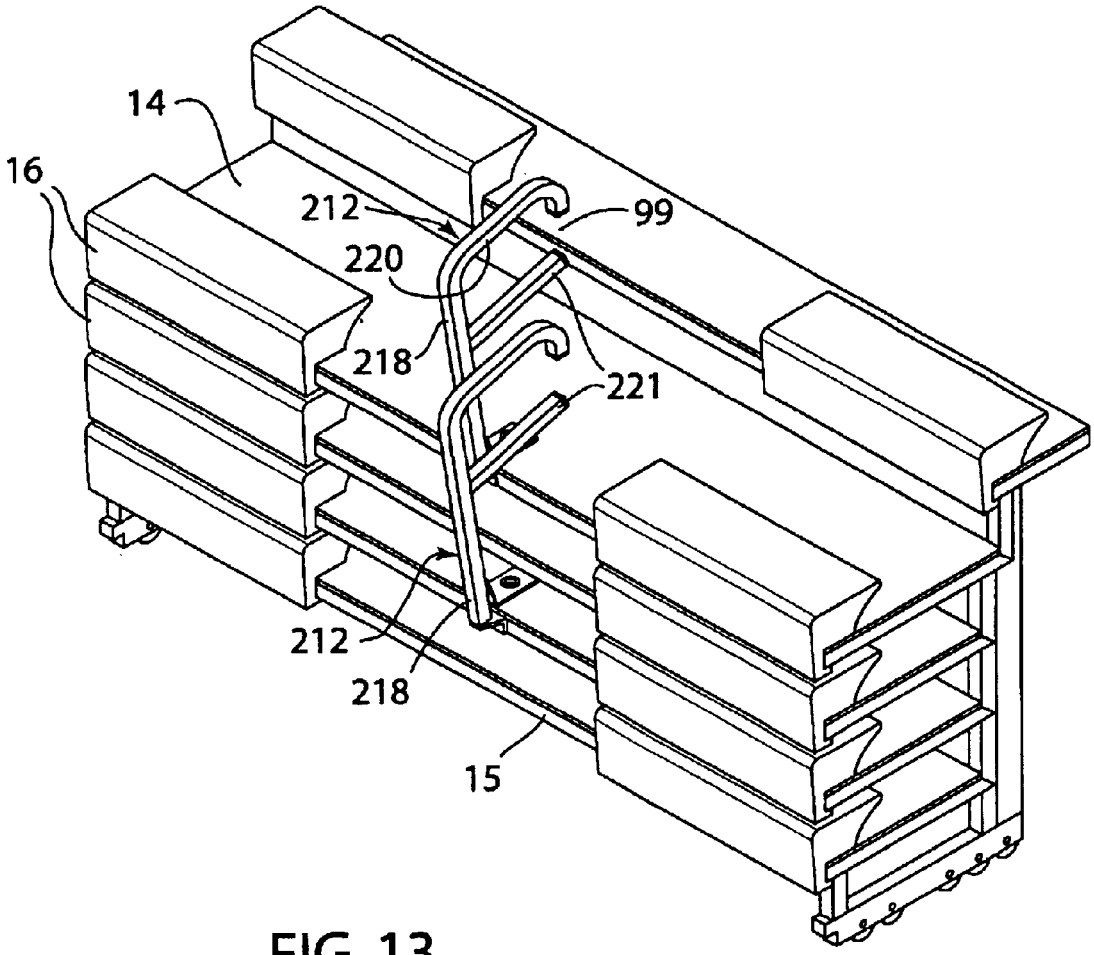
FIG. 13 is a perspective view of the alternative preferred embodiment of FIG. 12 shown in a retracted position.

FIGS. 12–13 show an alternate preferred embodiment of a telescoping seat assembly 210 with handrail assembly 212 where, instead of left and right handrails mounted on the same post, a single upper and lower handrail 220, 221 is shown. Each post 218 is offset from the one immediately above or below, as indicated by the phantom line shown in FIG. 12. This alternate preferred embodiment can also allow the telescoping seat assembly to move between extended and retracted positions. The opening 99 receives the rows of seating when in the retracted position in a manner similar to the second preferred embodiment, and the offset of the posts 218 prevents interference between each post and the handrails 220, 221 of the handrail assembly 112.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A self-storing telescoping seat assembly comprising, in combination:

rows of seating, movable between a retracted position where the rows of seating are generally stacked on top of one another, to an extended position, with each row of seating having a corresponding deck with a front face and a rear; and a handrail assembly affixed to a corresponding row of seating in a single assembled position with respect to that row, the handrail assembly comprising a post having a width, affixed to the corresponding row of seating, and a first top handrail and a first lower handrail each affixed to the post;

wherein each row of seating has a corresponding deck, an opening is formed between the top handrail and the lower handrail, and the deck of a row of seating above the corresponding row of seating is adapted to extend into the opening when the rows of seating are in the retracted position; and the handrail assembly stays in the single assembled position with respect to that row as the rows move between the extended position and the retracted position.

2. The self-storing telescoping seat assembly of claim 1 further comprising a second top handrail and a second lower handrail each affixed to the post wherein the first handrails are separated from the second handrails by a separation width which exceeds the width of the post.

3. The self-storing telescoping seat assembly of claim 2 wherein the separation width is adapted to receive a post mounted to a row of seating above the corresponding row when the rows of seating are in the retracted position.

4. The self-storing telescoping seat assembly of claim 2 further comprising a first spacing element positioned between the post and the first handrails, and a second spacing element positioned between the post and the second handrails.

5. The self-storing telescoping seat assembly of claim 1 wherein the top handrail is formed unitary with the lower handrail.

6. The self-storing telescoping seat assembly of claim 1 wherein the rows of seating each have a front face with the front faces generally aligned when the rows of seating are in the retracted position, and the handrail assembly comprises a post affixed to a corresponding row of seating where the post extends in front of the front faces when the rows are in the retracted position.

7. The self-storing telescoping seat assembly of claim 1 wherein the handrail assembly has a first post affixed to the corresponding row of seating, and a second post affixed to a second corresponding row of seating, and each post is mounted on its respective corresponding row of seating offset with respect to the other post so that the posts do not contact one another when the rows of seating move to the retracted position.

8. The self-storing telescoping seat assembly of claim 1 further comprising a center aisle and bleacher seats positioned on each row on either side of the center aisle, and the handrail assembly is positioned in the center aisle.

9. The self-storing telescoping seat assembly of claim 1 wherein the rows of seating can move between the extended position and the retracted position without the handrail assembly contacting any row other than the corresponding row.

10. A telescoping seat assembly comprising, in combination:

rows of seating, each row having a deck with a front face and a top face, the rows of seating being movable between a retracted position where the front faces of the rows are generally vertically aligned with each other, to an extended position where the front faces are not generally vertically aligned with each other; and a handrail assembly affixed to at least one corresponding row of seating, comprising a top handrail and a lower handrail which cooperate to form an opening;

wherein the deck of a row of seating is positioned between the top handrail and the lower handrail when the rows of seating are in the retracted position.

11. The telescoping seat assembly of claim 10 wherein the deck of a row of seating two rows above the corresponding row of the handrail assembly is received in the opening when the rows of seating are in the retract position.

12. The telescoping seat assembly of claim 11 wherein the handrail assembly further comprises a post having a first end and a second end, and the post is affixed to the corresponding row of seating at the first end, and the top hand rail is affixed to the post near the second end of the post.

13. The telescoping seat assembly of claim 12 further comprising a first attachment bracket connecting the first end of the post to the top face of the deck of the corresponding row of seating and a second attachment bracket connecting the first end of the post to the front face of the deck of the corresponding row of seating, and the second attachment bracket has a slot to accommodate tolerance variation.

14. A self-storing telescoping seat assembly comprising, in combination:

rows of seating, movable between a retracted position where the rows of seating are generally stacked on top of one another, to an extended position, with each row of seating having a corresponding deck with a front face; and a handrail assembly comprising a post affixed to at least one of the front faces and a top handrail and a lower handrail each affixed to the post and extending from the post in front of the front face of the corresponding deck;

wherein an opening is formed between top handrail and the lower handrail, and the deck of a row of seating above the corresponding row of seating is adapted to extend into the opening when the rows of sealing are in the retracted position; and the handrail assembly does not interfere with movement of the rows of seating between the extended position and the retracted position; and the handrail assembly stays in a single assembled position with respect to the front face as the rows move between the extended position and the retracted position.

15. The self-storing telescoping seat assembly of claim 14 wherein the post has a bend so that the handrail assembly is angled away from the front face of the corresponding deck.

16. The self-storing seat assembly of claim 14 wherein the rows of seating can move between the extended position and the retracted position without the handrail assembly contacting any row other than the corresponding row.

* * * * *

UNITED STATES PATENT AND TRADEMARK OFFICE

CERTIFICATE OF CORRECTION

PATENT NO. : 6,854,216 B2 
DATED : February 15, 2005
INVENTOR(S) : Ahrens et al.

It is certified that error appears in the above-identified patent and that said Letters Patent is hereby corrected as shown below:

Column 6,
Line 48, after "between" insert -- the --.
Line 51, delete "sealing" and replace with -- seating --.

Signed and Sealed this

Fifth Day of July, 2005

JON W. DUDAS
*Director of the United States Patent and Trademark Office*